US005838638A

United States Patent [19]

Tipton et al.

[11] Patent Number: 5,838,638

[45] Date of Patent: Nov. 17, 1998

[54] PORTABLE VERTICLE JUMP MEASURING DEVICE

[75] Inventors: Steven M. Tipton; Matt Hackworth; Kelly Willson, all of Tulsa, Okla.

[73] Assignee: The University of Tulsa, Tulsa, Okla.

[21] Appl. No.: 797,395

[22] Filed: Feb. 10, 1997

[51] Int. Cl.[6] ..... G04B 47/00; G04F 8/00; A63B 23/00

[52] U.S. Cl. ..... 368/10; 368/110; 482/8; 482/15

[58] Field of Search ..... 368/10, 12, 109–113; 36/132, 136, 137, 114; 482/1, 8, 79, 900, 901, 902; 73/379.01, 379.04, 379.06

[56] References Cited

U.S. PATENT DOCUMENTS 5,125,647 6/1992 Smith ..... 482/8
5,260,870 11/1993 Tsuchiya et al. ..... 364/413.02
5,343,445 8/1994 Cherdak ..... 368/10
5,401,224 3/1995 Tsuchiya et al. ..... 482/8
5,471,405 11/1995 Marsh ..... 364/556

*Primary Examiner*—Vit W. Miska
*Attorney, Agent, or Firm*—Head, Johnson & Kachigian

[57] ABSTRACT

A method to measure height of a vertical jump of a jumper. At least one switch is deactivated by the jumper stepping thereon. The switch is initially activated by the jumper jumping upward therefrom and thereafter deactivated upon return. A time period is measured while the switch is activated. The square of the activated time period is calculated and thereafter the result is multiplied by a constant to derive vertical jump height. Finally, the resultant vertical jump height of the jump is displayed.

10 Claims, 3 Drawing Sheets

PORTABLE VERTICLE JUMP MEASURING DEVICE

BACKGROUND OF THE INVENTION

1. Field of the Invention

The present invention is directed to a portable device to measure the vertical jump height of an athlete. In particular, the present invention is directed to a portable jump height vertical measuring device which will compute the time period that the jumper's feet are off the floor during a jump and convert that time period to a vertical jump height measurement.

2. Prior Art

Measuring the vertical jump height of an athlete is a test performed by athletic coaches and evaluators around the world. It tells how much power the athlete can exert from his or her legs and also gives a general idea about the jumping potential of the athlete. While vertical jump height is most often associated with the sport of basketball, it is also pertinent to other sports, such as football.

In the past, one method of measuring vertical jump height involved a large movable frame having a series of shims extending from the frame side. The athlete would zero the fixture to his or her body and then knock away as many shims as possible while jumping. The knocked-away shims would indicate the vertical jump of the athlete. This procedure would be prone to cheating if the zeroing phase were not accurate. Additionally, the fixture was typically not portable. Additionally, oftentimes the height indication would be 8 to 12 feet above floor level and, therefore, not conveniently observed.

Additionally, in the past, a shoe has been modified as shown in Cherdak (U.S. Pat. Nos. 5,343,445; 5,452,269) to include a timer device within the shoe. The timer device would measure the "hang time" and not the vertical jumping height. Moreover, the timing device is a part of and within the athletic shoe and is not conducive to testing many athletes quickly.

Various other timing devices are well known, such as swim racing timers. One example is shown in Tenaka(SP) (U.S. Pat. No. 5,349,569).

It is known that when an object is set into vertical upward motion, its position can be described using Newtonian physics. When a person jumps, the center of mass is first lowered, then propelled upward with leg strength. At the exact instant the feet leave the ground, the person's center of mass is moving upward at a velocity of $V_0$. While in the air, the person is accelerating downward at a constant value, given by g (the acceleration due to gravity). Although this value varies with the person's distance from the center of the earth, in general a value of g=386.4 inches/second$^2$ is applicable over a wide range of practical elevations.

By measuring the total time period of the jump, a vertical jump height can be derived.

It is, therefore, an object and purpose of the present invention to provide a portable, vertical jump measuring device which will measure the vertical jump height of a jumper.

It is a further object and purpose of the present invention to provide a portable, vertical jump measuring device which will calculate the time period of a jump and convert the time period into a vertical jump height measuring.

It is a further object and purpose of the present invention to provide a vertical jump measuring device which is portable and lightweight.

It is a further object and purpose of the present invention to provide a vertical jump measuring device that may be used to obtain measurements quickly and thereafter to reset for additional measurements.

It is a further object and purpose of the present invention to measure the force of the jumper upon take-off and landing as well as the time period of the jump and convert those measurements into vertical jump height.

SUMMARY OF THE INVENTION

The present invention is directed to a vertical jump measuring device for measuring the vertical jump height of a jumper.

In one embodiment, the device includes a portable mat which is both lightweight and easy to transport. Embedded within the mat are a plurality of pressure sensitive switches which are wired together in parallel. The switches are normally open and may be closed in response to pressure thereon from the feet of a jumper.

Closing of any one of the switches allows an electrical voltage to pass through a circuit and through a cable extending from the mat. Power to the circuit may be in the form of battery power. Alternatively, power may be provided by alternating current wired to a transformer to convert to low voltage direct current. A timer is connected to a microprocessor which is, in turn, connected to a display and controller.

To measure vertical jump height, the jumper will start with both feet on the mat in a standing, upright position. This serves to close at least one switch. The jumper will first bend his or her knees and lower the body. The jumper will thereafter jump to his or her maximum height and, then, by force of gravity, return to the mat. When the jumper is in the air, all switches will be open. When the jumper returns to the mat, at least one switch will close. The timer will measure the open time period when the jumper is in the air. By calculating the square of the open time period and thereafter multiplying the results by a constant, vertical jump height may be derived and immediately displayed.

DETAILED DESCRIPTION OF THE PREFERRED EMBODIMENTS

Figure 1:
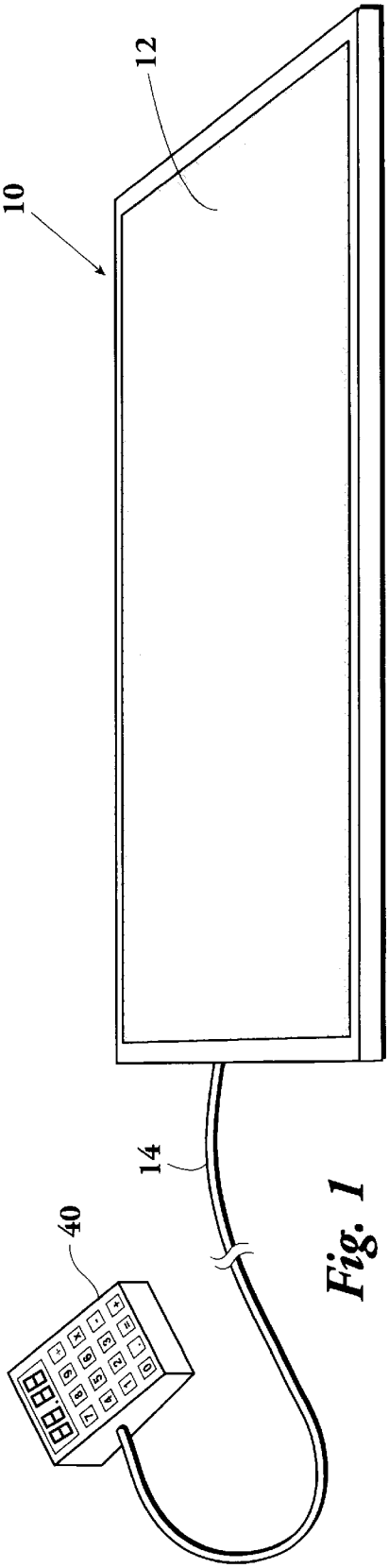
FIG. 1 is a perspective view of a portable vertical jump measurement device constructed in accordance with the present invention.

Referring to the drawings in detail, FIG. 1 shows a perspective view of a preferred embodiment of a vertical jump measuring device 10 constructed in accordance with the present invention.

The device 10 includes a portable mat 12 which is lightweight and easy to transport. In a preferred embodiment, the entire device weighs less than ten pounds. The particular structure of the device would, of course, be a matter of choice within the confines of the invention.

The dimensions of the mat will be variable, although a jumper will easily be able to fit both feet on the mat 12. In one embodiment, the mat will be no thicker than ¼ inch to 1 inch. The mat 12 may be flexible so that it can be rolled up after use for storage or transportation.

An electrical conducting cable 14 may extend from the mat 12 and terminate in a control box 16. Alternately, wireless communication between the mat and indicator could be employed.

Figure 2:
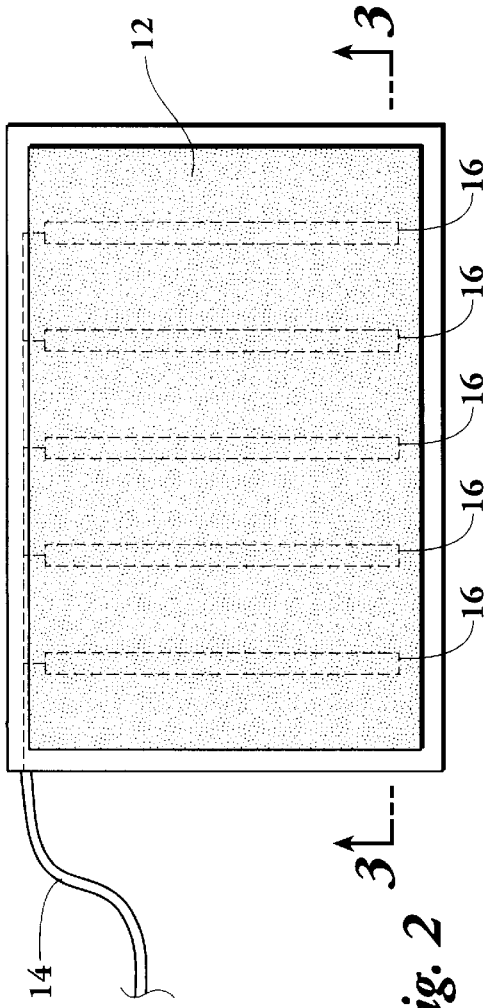
FIG. 2 is a top view of a portable mat which is a part of the portable jump measurement device shown in FIG. 1.
Figure 3:
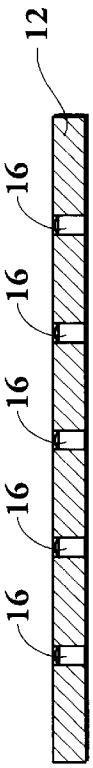
FIG. 3 is a sectional view taken along section line 3—3 of FIG. 2.

FIG. 2 shows a top view of the mat 12 shown in FIG. 1 and FIG. 3 shows a cross-sectional view of the portable mat 12.

Embedded within the mat 12 are a plurality of pressure sensitive switches 16 (shown in dashed line form in FIG. 2). In the embodiment shown, ribbon switches are employed although other types may be used. As an example, an array of button switches might be employed.

As seen in FIG. 2, the switches 16 are aligned with each other, spaced apart and parallel with each other. The number of switches is a matter of choice although there will be enough switches so that a jumper's foot on the mat will be on at least one switch. As will be explained in detail, the pressure sensitive switches 16 are wired together in parallel.

The switches are normally open and may be closed in response to pressure thereon from the feet of a jumper (not shown in FIGS. 1–3).

Figure 4:
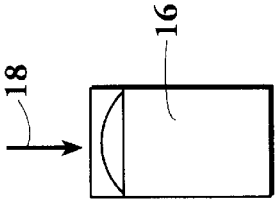
FIG. 4 is a pressure sensitive switch shown apart from the portable mat of the vertical jump measurement device of the present invention.

FIG. 4 shows an enlarged view of one of the pressure sensitive switches 16 apart from the mat 12. Pressure exerted in the direction shown by arrow 18 will close the normally open switch.

Closing of any one of the pressure sensitive switches 16 will allow an electrical voltage to pass through the circuit and through the cable 14.

Figure 5:
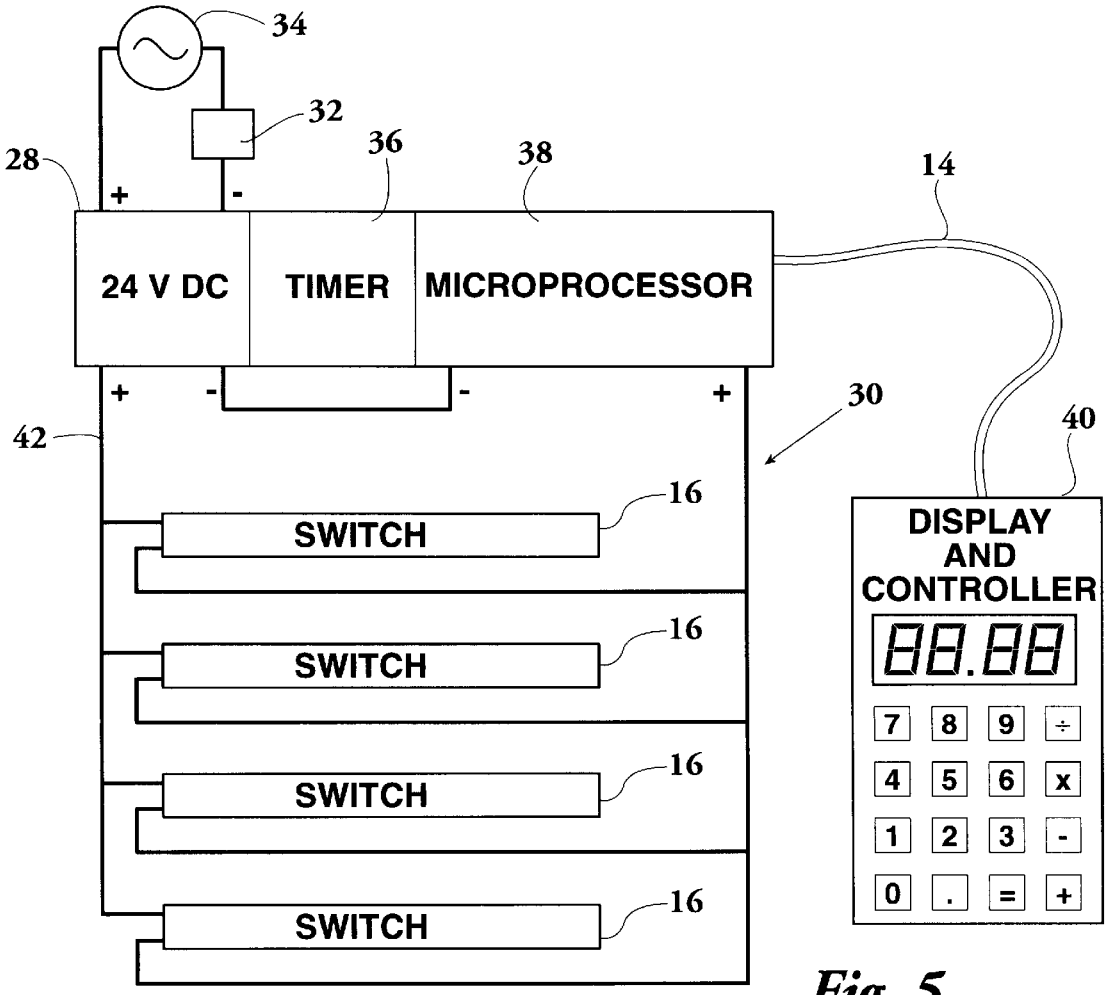
FIG. 5 is a simplified circuit diagram of the portable jump measurement device shown in FIG. 1.

FIG. 5 illustrates a simplified circuit diagram 30 of the portable, vertical jump measuring device 10 of the present invention. A plurality of the pressure sensitive switches 16 are shown wired in parallel. Accordingly, closing of any one or more of the switches 16 will allow voltage to pass in and through the circuit.

The circuit 30 may include an optional ON/OFF switch 32 to terminate power. Power to the circuit is shown at reference numeral 34 and may be in the form of battery power or, alternatively, alternating current wired to a transformer 28 to convert to low voltage direct current. In the present embodiment, normal 120 volt, 60 Hz alternating current (AC) is converted to 24 volt direct current (DC). The circuit 30 includes a timer 36 connected to a microprocessor 38. The microprocessor 38 is, in turn, connected to a display and controller 40 which will be contained within the control box 16.

As seen in FIG. 5, voltage from the transformer 28 passes via wire 42 through each of the pressure sensitive switches and thereafter to the microprocessor 38. This is represented as the positive side (+) of the circuit.

The negative side of the circuit (−) passes from the microprocessor 38 back to the transformer 28. The timer is connected to both the transformer 28 for power supply and to the of microprocessor 38.

The display and controller 40 will display the resultant vertical height of the jump after calculation.

Figure 6:
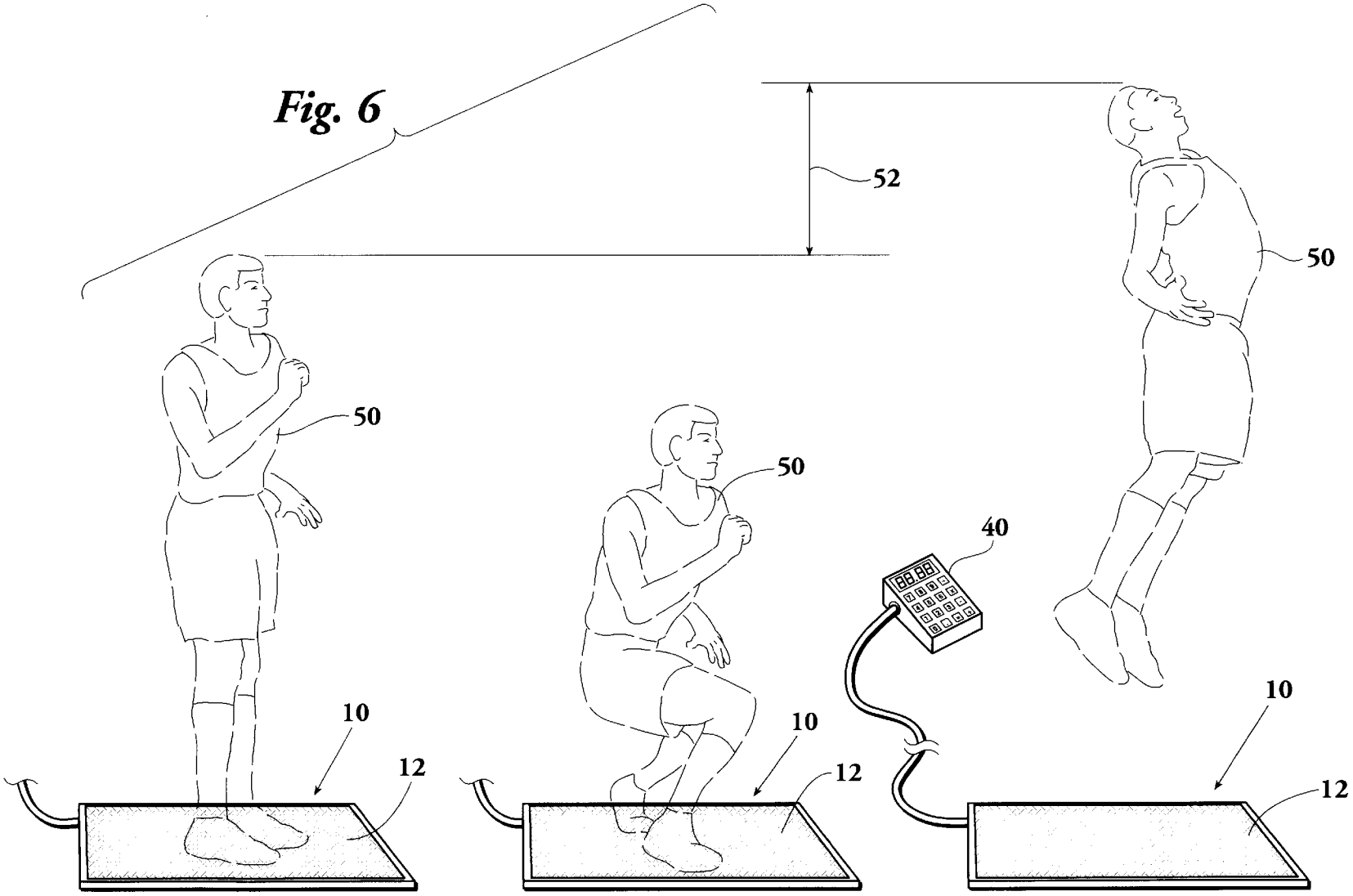
FIG. 6 is a sequential view of a jumper (shown by dashed lines) using the portable jump measurement device of the present invention.

FIG. 6 shows the sequential process as a jumper 50 or other athlete utilizes the jump measuring device 10 to determine vertical jump height. FIG. 6 shows three stages of a jump depicted from left to right.

As seen in the first stage in FIG. 6, the jumper will start with both feet on the mat 12 in a standing, upright position. To begin the jump, the jumper 50 will first bend his or her knees and lower the body as seen in the second stage.

Thereafter, the jumper will jump to his or her maximum height as seen in the final stage in the sequence shown in FIG. 6. When the jumper leaves the mat, the timer will begin. The arrow 52 shows the total vertical jump of the jumper. The timer will continue counting until the jumper returns to the mat (not seen in FIG. 6).

When a person jumps, the center mass of the body is first lowered, then propelled upward with leg strength. At the instant the jumper's feet leave the ground, the center of mass is moving upward at a velocity of $V_0$. While in the air, the person is accelerating downward (or decelerating) at a constant value given by the letter g (the acceleration due to gravity). The direction of velocity changes after the top position of the jump, and, thus, deceleration is followed by acceleration.

For this motion, if the person's initial height is taken as zero prior to the jump (while standing straight and still), then the vertical position, y, of the center of gravity can be described as a function of time, t, by the equation:

$$y = V_o t - \frac{1}{2} gt^2 \qquad \text{Equation 1}$$

(In this example, wind resistance is neglected). This equation can be used to define the time at which the mass raises to its maximum height, then returns to its original height of zero (by setting y=0). This leads to the equation:

$$V_o = \frac{gt}{2} \qquad \text{Equation 2}$$

The height of the jump can be directly related to the initial velocity using conservation of energy considerations. The initial kinetic energy, $E_k$, of the person at the instant the feet leave the ground is:

$$E_K = \frac{1}{2} \text{ mV}_o^2 \qquad \text{Equation 3}$$

where m is the mass of the person making the jump. At the peak height of the jump, the vertical speed diminishes to zero, and the change in gravitational potential energy is maximized due to the increase in the person's height to a value of h. The gravitational potential energy, $E_g$, is related to the change in height from the relation:

$$E_g = \text{mgh} \qquad \text{Equation 4}$$

Setting equation 3 equal to equation 4.

$$V_o = \sqrt{2gh} \qquad \text{Equation 5}$$

Setting equation 5 equal to equation 2, then the final relation between the time the feet are in the air, t, and the height of the jump, h, is given by:

$$h = \frac{gt^2}{8} \quad \text{Equation 6}$$

Assuming g=386.4 in/s$^2$, the jump height is obtained in units of inches by squaring the time, t, in seconds and multiplying by the constant 48.265. Thus, the final equation is:

$$h=48.2625t^2 \quad \text{Equation 7}$$

The height could easily be obtained in other units (e.g., centimeters) with standard metric conversion factors.

It will be understood that the switches might be wired in reverse fashion and still achieve the objects of the invention. For example, with normally closed switches, the device could be configured to measure the time the switch is closed.

While the foregoing has been described with respect to measuring a standing jump, the device 10 could also be used to measure a running jump.

The key pad could include a command to reset the circuit and timer, so that a new jump could be measured. Alternatively, the microprocessor could include a command to reset once a jumper stepped on the mat.

Figure 7:
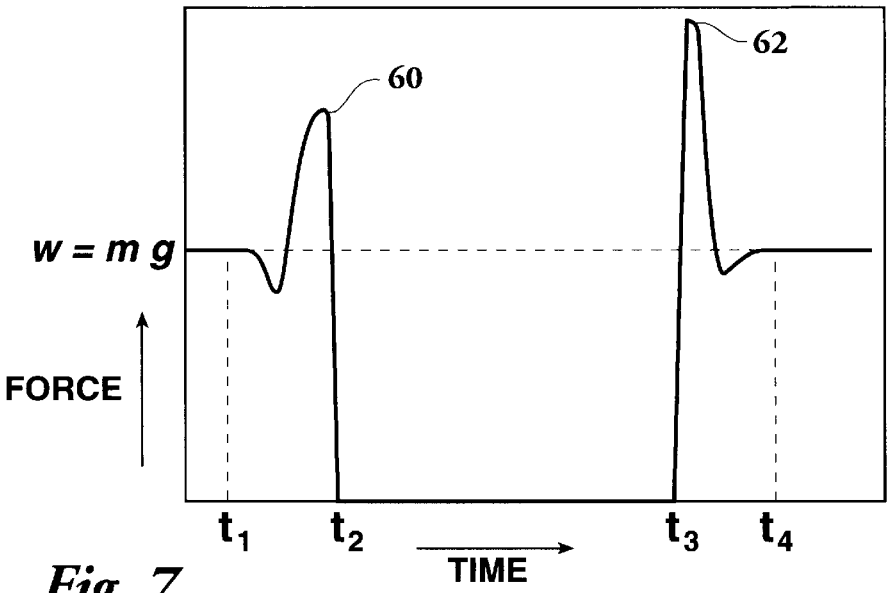
FIG. 7 is a chart illustrating force and time parameters to illustrate the measurement of forces during take off and landing for an alternate embodiment of the present invention.

An alternate process and device may be used to calculate the vertical jump height of a jumper. As seen in FIG. 7, by measuring the force of take-off and landing of a jumper, the vertical height of a jump can be derived.

If the matrix of switches in the floor mat 12 of the embodiment in FIGS. 1–6 were replaced with a calibrated force measurement device (like a scale) then the force versus time data exerted by the feet of the jumper on the mat during take-off and landing could be processed to provide three independent measures of jump height. In the alternate process and device, the force measurement device would be embedded in the mat.

Referring to FIG. 7, a take-off impulse 60 and landing impulse 62 are evident. This force versus time profile, which would be recorded digitally with data acquisition hardware and software, provides three independent measurements of the height of the jump: (1) the time from t2 to t3 (t=t3−t2) can be used in equation 6 exactly as described previously. (2) the impulse (defined as the area under the force versus time curve) for take-off from t1 to t2 can be used with the principle of impulse and momentum to define the upward velocity of the jumper, $V_0$, exactly at time=t2, and used with equation 5 to compute height. (3) similarly, the impulse at landing from t3 to t4 can be used to compute the velocity of the feet just prior to landing at time=t3 and again used with equation 5 to compute height. The heights computed from the impulse relations should differ only by the difference in the height of the jumper's center of gravity at t2 and t3. (That is, if the legs are slightly bent at landing, a slightly higher final velocity could be computed).

As depicted in FIG. 7, the magnitude of the maximum force for the landing pulse could be considerably higher than that for take-off. However, the duration of the force spike will be shorter, such that the impulse 62 (the area under the curve) from the taller, narrower landing curve is identical to the shorter, wider take-off impulse 60.

When computing the impulses acting on the jumper from time t1 to tf, both the force on the jumper's feet, F (as measured by the transducer in the mat), and the constant gravitational force acting on the jumper's center of gravity (w=mg) must be considered, as in equation 6.

$$\int_{t_f}^{t_i} F dt - w(t_f - t_i) = \left(\frac{w}{g}\right)(V_f - V_i) \quad \text{Equation 8}$$

For the take-off impulse, $t_1=t_1$ and $t_f=t_2$. The initial velocity is zero and final velocity, $V_f$, is the jumper's take-off velocity, which is positive (upward). For the landing impulse, $t_1=t_3$ and $t_4$. The initial velocity, $V_i$, is the jumper's landing velocity, which is negative (downward), and the final velocity is zero. The velocities are used to compute height with equation 6.

The resultant vertical jump height could be displayed on a digital display similar to that shown in the embodiment in FIGS. 1–6.

The force versus time data contained in the take-off impulse could be used by therapists and athletic trainers to analyze a jumper's technique. Specialized drills and exercises could be prescribed, based on the take-off impulse, specifically to improve jump height. Using the device, the effectiveness of these exercises could be quantitatively assessed.

Whereas, the present invention has been described in relation to the drawings attached hereto, it should be understood that other and further modifications, apart from those shown or suggested herein, may be made within the spirit and scope of this invention.

What is claimed is:

1. A portable vertical jump measuring device, which comprises:

a plurality of normally open switches wired in parallel, each said switch being adapted to deliver a signal and deactivated in response to a jumper stepping thereon, wherein said switches are embedded in a portable mat;

a timer connected to said switch and adapted to receive said switch signal to measure a time period said switch is activated while said jumper is in the air;

means to receive said measured time period and to calculate the square of said activated time period and thereafter multiply the result by a constant to derive vertical jump height; and an output device connected to said means to display the resultant vertical jump height of said jumper.

2. A portable vertical jump measuring device as set forth in claim 1 wherein said switches are ribbon switches.

3. A portable vertical jump measuring device as set forth in claim 1 wherein said time is measured in seconds, said height is measured in inches and said constant is equal to 48.2625.

4. A portable vertical jump measuring device as set forth in claim 1 wherein said timer, said means to multiply, and said display are contained in a portable case.

5. A portable vertical jump measuring device as set forth in claim 1 wherein said means to calculate is performed by a microprocessor.

6. A portable vertical jump measuring device as set forth in claim 5 wherein said microprocessor, said timer and said display are powered by at least one battery.

7. A method to measure vertical jump height of a jumper, which method comprises:

wiring a plurality of normally open switches in parallel and embedding said plurality of switches in a portable mat;

closing at least one of said plurality of normally open switches by said jumper stepping thereon;

opening said at least one switch by said jumper jumping therefrom and thereafter closing said switch;

measuring a time period while said at least one switch is open;

calculating the square of said open time period and thereafter multiplying the result by a constant to derive vertical jump height; and displaying the resultant vertical jump height of said jump.

8. A method to measure vertical jump height as set forth in claim 7 including measuring said time period in seconds, measuring said vertical height in inches, and using a constant of 48.2625.

9. A method to measure vertical jump as set forth in claim 7 including performing said calculations with a microprocessor.

10. A portable vertical jump measuring device, which comprises:

a plurality of normally closed switches wired in parallel, each said switch being adapted to deliver a signal and activated in response to a jumper stepping thereon, wherein said switches are embedded in a portable mat;

a timer connected to said switch and adapted to receive said switch signal to measure a time period said switch is deactivated while said jumper is in the air;

means to receive said measured time period and to calculate the square of said activated time period and thereafter multiply the result by a constant to derive vertical jump height; and an output device connected to said means to display the resultant vertical jump height of said jumper.

* * * * *